US007275663B2

(12) United States Patent
Campbell et al.

(10) Patent No.: US 7,275,663 B2
(45) Date of Patent: Oct. 2, 2007

(54) DISPENSING DEVICE USING MULTIPLE GAS CARTRIDGES

(75) Inventors: David C. Campbell, Bel Air, MD (US); Allen K. Brelsford, Baldwin, MD (US)

(73) Assignee: Black & Decker Inc., Newark, DE (US)

( * ) Notice: Subject to any disclaimer, the term of this patent is extended or adjusted under 35 U.S.C. 154(b) by 471 days.

(21) Appl. No.: 10/828,105

(22) Filed: Apr. 20, 2004

(65) Prior Publication Data

US 2005/0230434 A1 Oct. 20, 2005

(51) Int. Cl.
*B67D 5/42* (2006.01)

(52) U.S. Cl. ..... 222/389; 222/327

(58) Field of Classification Search ..... 222/325–327, 222/397–399, 396, 129, 258, 261–263, 491, 222/389, 394
See application file for complete search history.

(56) References Cited

U.S. PATENT DOCUMENTS

| | | | |
|---|---|---|---|
| 2,818,999 | A | 1/1958 | Miller |
| 3,138,303 | A | 6/1964 | Hoveland |
| 3,308,998 | A | 3/1967 | Oppasser et al. |
| 3,568,892 | A | 3/1971 | Burk |
| 3,587,930 | A | 6/1971 | Schultz |
| 3,640,431 | A | 2/1972 | Plumer |
| RE28,120 | E | 8/1974 | Plumer |
| 3,877,610 | A | 4/1975 | Dickey |
| 3,980,209 | A | 9/1976 | Collar |
| 3,983,947 | A | 10/1976 | Wills et al. |
| 3,987,939 | A | 10/1976 | Pedone, Jr. et al. |
| 4,215,802 | A | 8/1980 | Ornsteen |
| 4,284,213 | A | 8/1981 | Lee |
| 4,299,336 | A | 11/1981 | Studer |

(Continued)

FOREIGN PATENT DOCUMENTS

| | | |
|---|---|---|
| DE | 2036423 | 3/1971 |

(Continued)

OTHER PUBLICATIONS

Brandywine Associates, "Dispensing and Mixing Equipment for Adhesives and Chemicals", www.staticmixerdispenser.com/index, Feb. 10, 2003, 3 page printout.

(Continued)

*Primary Examiner*—Lien M. Ngo
(74) *Attorney, Agent, or Firm*—Harness, Dickey & Pierce, P.L.C.

(57) ABSTRACT

A manifold includes a plurality of inlet passages provided in fluid communication between an inlet and an outlet passage. A housing retains a pressurized gas cartridge in sealed fluid communication with each of the inlet passages. A check valve is located in at least one of the inlet passages. The check valve is biased to a closed position that prevents gas from flowing through the check valve to the inlet of the inlet passage. Thus, gas cannot exit through the inlet when a pressurized gas cartridge is not sealed thereto. The housing retains a viscous product cartridge and forms a gas enclosure separated from a product enclosure by a movable wall. The gas from the pressurized gas cartridges passes into the gas enclosure and generates a force on the movable wall to dispense product from the product cartridge.

17 Claims, 4 Drawing Sheets

U.S. PATENT DOCUMENTS

| | | | | |
|---|---|---|---|---|
| 4,340,154 | A | | 7/1982 | VanManen |
| 4,376,498 | A | | 3/1983 | Davis, Jr. |
| 4,382,530 | A | | 5/1983 | Calisto |
| 4,386,717 | A | | 6/1983 | Koob |
| 4,426,022 | A | | 1/1984 | Lang et al. |
| 4,441,629 | A | | 4/1984 | Mackal |
| 4,453,651 | A | | 6/1984 | Braithwaite et al. |
| 4,461,454 | A | | 7/1984 | Vadnais |
| 4,637,531 | A | | 1/1987 | Olsson |
| 4,685,595 | A | | 8/1987 | Segatz |
| 4,844,301 | A | | 7/1989 | Juillet |
| D303,914 | S | | 10/1989 | Hinden et al. |
| 4,925,061 | A | | 5/1990 | Jeromson, Jr. et al. |
| 4,957,225 | A | | 9/1990 | Childers |
| 4,986,444 | A | | 1/1991 | Corso |
| 5,058,769 | A | | 10/1991 | Kurtz |
| D321,309 | S | | 11/1991 | Myers |
| 5,104,013 | A | | 4/1992 | Hawley |
| 5,181,636 | A | | 1/1993 | Anderson et al. |
| 5,203,507 | A | | 4/1993 | Matthews |
| D342,654 | S | | 12/1993 | Jens |
| D343,103 | S | | 1/1994 | Bunce |
| 5,297,697 | A | | 3/1994 | Boring |
| 5,361,941 | A | | 11/1994 | Parekh et al. |
| D357,392 | S | | 4/1995 | Kimpel et al. |
| 5,492,249 | A | | 2/1996 | Beach |
| 5,535,925 | A | | 7/1996 | Hinden et al. |
| 5,556,009 | A | | 9/1996 | Motzko |
| 5,573,148 | A | | 11/1996 | Poole et al. |
| 5,595,327 | A | | 1/1997 | Dentler et al. |
| 5,732,752 | A | * | 3/1998 | Glessner et al. ..... 141/329 |
| 5,833,099 | A | | 11/1998 | Boaz et al. |
| 5,887,765 | A | | 3/1999 | Broesamle |
| 5,979,713 | A | * | 11/1999 | Grill ..... 222/399 |
| 6,022,504 | A | | 2/2000 | Boaz et al. |
| 6,032,830 | A | | 3/2000 | Brown |
| 6,039,223 | A | | 3/2000 | Damask |
| 6,062,428 | A | | 5/2000 | Callahan |
| 6,488,180 | B1 | | 12/2002 | Bayat |
| 6,672,489 | B1 | | 1/2004 | Huang |
| 2002/0108971 | A1 | | 8/2002 | Lafond |
| 2002/0145014 | A1 | | 10/2002 | Harris |
| 2004/0074927 | A1 | | 4/2004 | Lafond |

FOREIGN PATENT DOCUMENTS

| | | |
|---|---|---|
| DE | 2944969 | 5/1980 |
| DE | 3409724 | 9/1985 |
| DE | 3526141 | 2/1986 |
| DE | 3526142 | 2/1986 |
| DE | 3920694 | 1/1991 |
| DE | 9419733.4 | 6/1995 |
| EP | 0290259 | 11/1988 |
| GB | 2162902 | 2/1986 |
| GB | 2162903 | 2/1986 |
| JP | 56-089865 | 7/1981 |
| JP | 62-011571 | 1/1987 |
| JP | 64-038164 | 2/1989 |
| JP | 02-144168 | 6/1990 |
| JP | 06-000428 | 1/1994 |
| JP | 06-099122 | 4/1994 |
| JP | 09-024981 | 1/1997 |
| JP | 2001-315864 | 11/2001 |

OTHER PUBLICATIONS

C.R. Laurence Co. Inc. (CRL), "CRL Introduces New Sealant and Caulking Gun Duo", USGlass, Metal & Glazing, Mar. 2001, p. 65.
Essex ARG, "EssexPak System Saves Time and Money", Glass Digest, May 15, 2001; p. 57.
TAH Industries, "Cartridge Systems", www.tah.com/display, Feb. 10, 2003, 1 page printout.

* cited by examiner

DISPENSING DEVICE USING MULTIPLE GAS CARTRIDGES

FIELD OF THE INVENTION

The present invention relates to dispensers for dispensing viscous products; and more specifically, to such dispensers which are driven by a pressurized gas cartridge.

BACKGROUND OF THE INVENTION

Gas operated dispensing devices for viscous products such as adhesives or caulks are known. The gas for driving such viscous product dispensing devices has been supplied by a pressurized gas cartridge. Typically, however, such a pressurized gas cartridge has a fairly limited supply of pressurized gas. For example, commercially available pressurized $CO_2$ cartridges typically come in 12, 16 and 25 gram sizes. Thus, it is necessary to frequently replace such pressurized gas cartridges. Of course, such frequent replacement operations can significantly disrupt product dispensing. The disruption can be magnified, for example, when it is necessary to locate and retrieve a replacement pressurized $CO_2$ cartridge from a storage location that is separate from the dispensing device. Such frequent disruption of the dispensing operation can meaningfully increase the time required to complete a caulk or adhesive product application.

SUMMARY OF THE INVENTION

In accordance with one aspect of the present invention a dispensing device for dispensing a viscous product is provided. The dispensing device is adapted to be driven by a plurality of pressurized gas cartridges is provided. The dispensing device includes a manifold with a plurality of inlet passages. Each of the passages provides fluid communication between an inlet and an outlet passage. A housing is adapted to retain a pressurized gas cartridge in sealed fluid communication with each of the inlet passages. A check valve is located in at least one of the inlet passages. The check valve is biased to a closed position that prevents gas from flowing through the check valve to the inlet of the inlet passage. The dispensing device is adapted to use gas delivered through the outlet passage to dispense the viscous product from the dispensing device.

In accordance with another aspect of the present invention a dispensing device adapted to dispense a viscous product from a viscous product cartridge is provided. The dispensing device is also adapted to be driven by a plurality of pressurized gas cartridges. The dispensing device includes a product housing component adapted to retain the viscous product cartridge and to cooperate with the viscous product cartridge to form a gas enclosure separated from a product enclosure by a movable wall. A fluid passage has a plurality of inlets. The fluid passage provides fluid communication between the plurality of inlets and the gas enclosure. A gas housing component is adapted to retain each of the pressurized gas cartridges in sealed fluid communication with one of the inlets. A check valve is located in the passage and associated with at least one of the inlets. The check valve is biased to a closed position that prevents gas from flowing through the check valve to the at least one of the inlets.

In accordance with yet another aspect of the present invention a dispensing device for dispensing a viscous product is provided. The dispensing device is adapted to be driven by a plurality of pressurized gas cartridges. The dispensing device includes a movable wall separating a product enclosure from a gas enclosure. The product enclosure has a dispensing orifice. A fluid passage has a plurality of inlets. The fluid passage provides fluid communication between the inlets and the gas enclosure. Each of the inlets is adapted to seal to one of the pressurized gas cartridges. A check valve is located in the fluid passage and is associated with at least one of the inlets. The check valve has an open position that permits gas to flow from the at least one of the inlets through the check valve. The check valve also has a closed position that prevents gas from flowing through the check valve and exiting the passage through the at least one of the inlets. The dispensing device is adapted to cause gas from the gas cartridges to flow through the fluid passage into the gas enclosure and to cause the movable wall to move so that the gas enclosure expands and the product enclosure contracts, to thereby cause viscous product to be dispensed through the dispensing orifice of the product enclosure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. For example, although the dispensing device is described herein as preferably being driven by pressurized $CO_2$ cartridges, other pressurized gas cartridges, including aerosol containers, may alternatively be used.

As used herein, "pressurized gas cartridge" means a container that is capable of housing a material that can be dispensed from the container in the form of a pressurized gas. Thus, it is possible that the material inside the container is, at least partially, in a form that is not gaseous. Similarly, the phrase "product cartridge" as used herein, means a container capable of housing a product for shipping and/or storage and for dispensing. Thus, the term "cartridge" does not, in itself, require any specific structural configuration.

Figure 1:
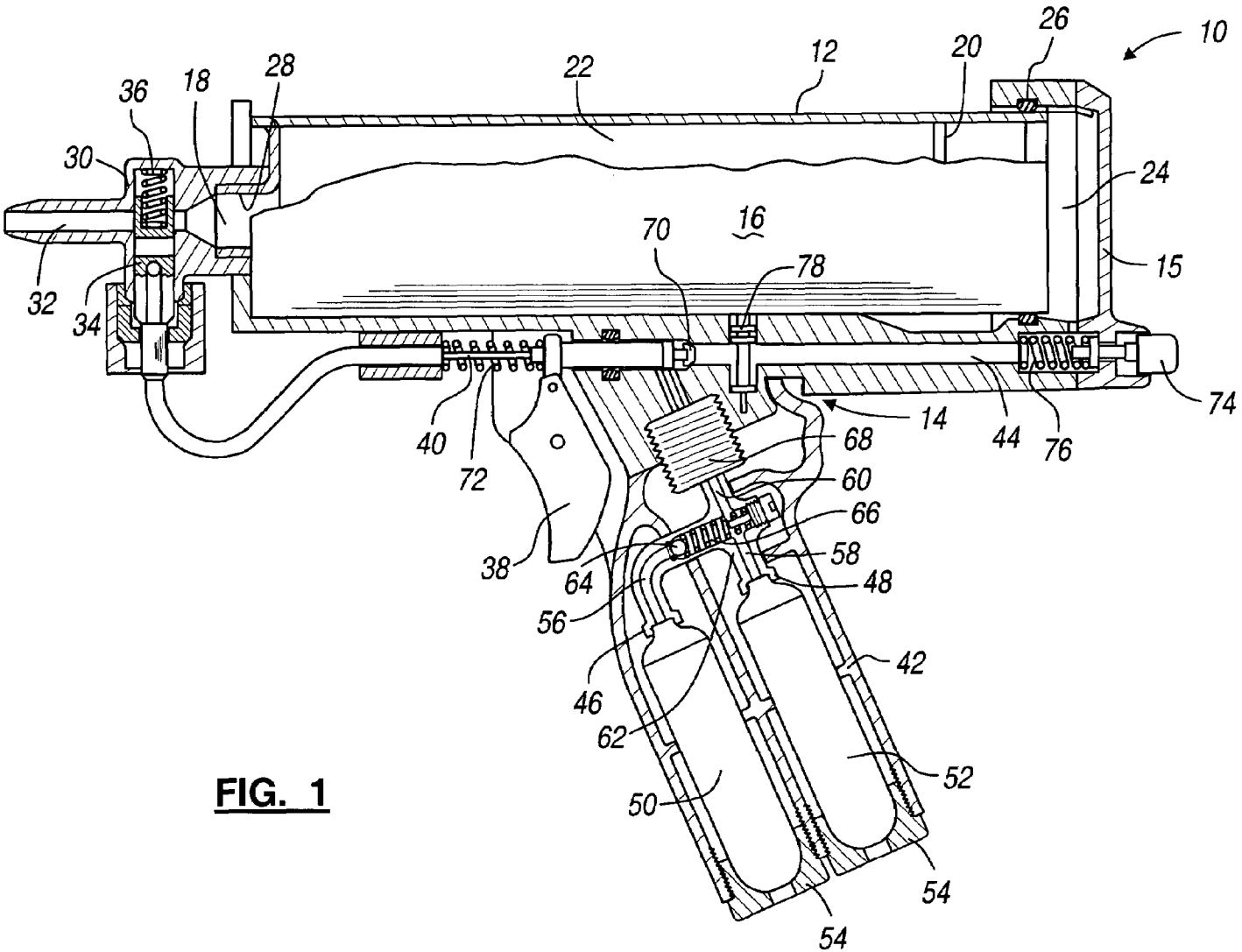
FIG. 1 is a cross-sectional view of a dispensing device in accordance with one preferred embodiment of the present invention.
Figure 2:
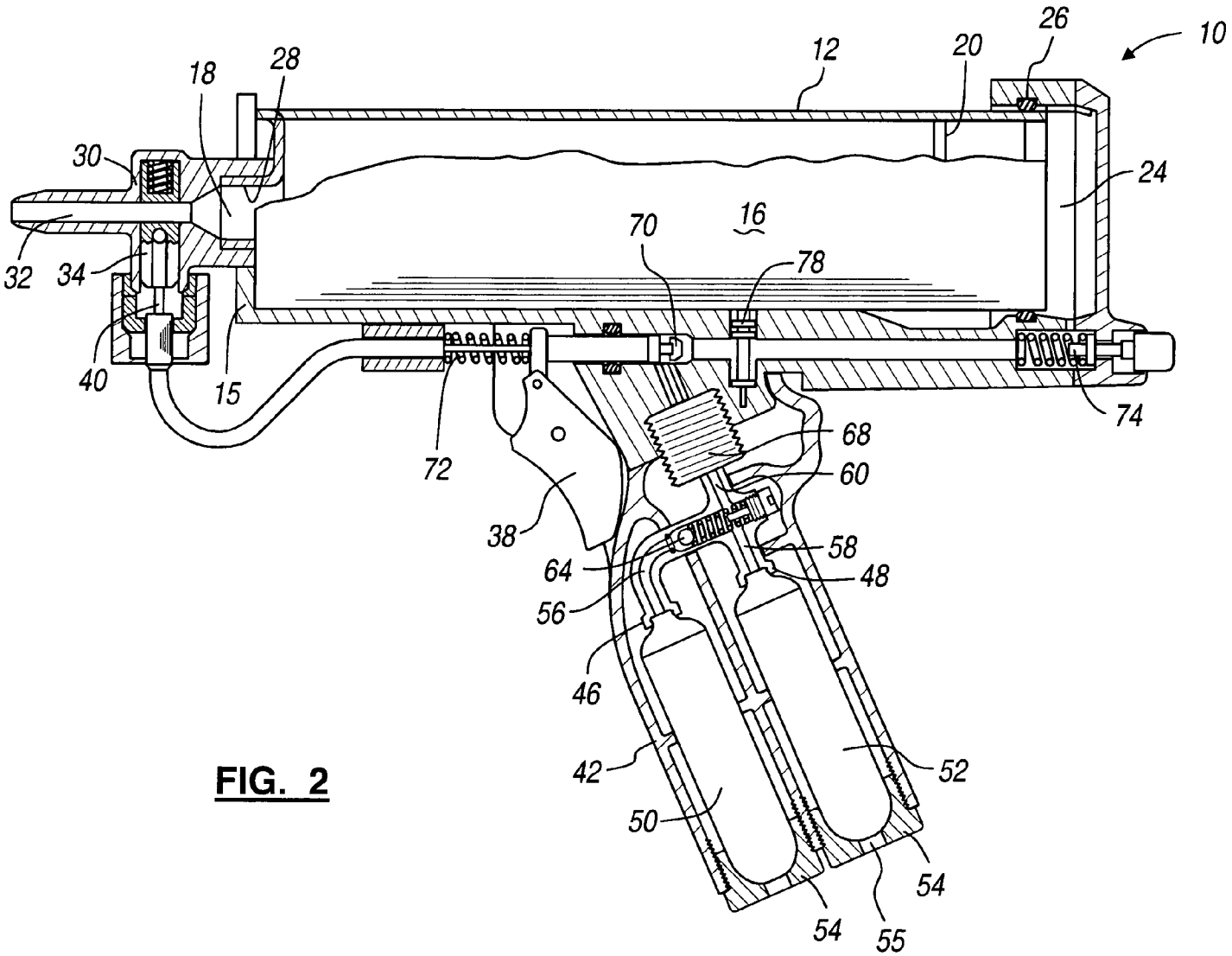
FIG. 2 is a cross-sectional view of the dispensing device of FIG. 1, but with various valves in their dispensing position.

Referring to FIGS. 1 and 2, one preferred embodiment of a dispensing device 10 for dispensing a viscous product from a viscous product cartridge 12 is illustrated. The dispensing device 10 includes a housing 14. The housing 14 includes an upper portion that operates as a product cartridge housing component 15. This product cartridge housing component 15 is adapted to retain the viscous product cartridge 12. In the illustrated embodiment, the viscous product cartridge 12 is a cylindrical tubular member having a relatively rigid cylindrical wall 16. For example, the cylindrical wall 16 may be formed of cardboard or plastic. Such tubular cartridges 12 are commonly used in conjunction with or in association with construction adhesives, sealants and caulks.

At one end of such cylindrical tubular product cartridge 12 is a dispensing orifice 18. The dispensing orifice 18 may be provided, for example, by cutting the end of a nozzle (not shown) that is typically provided on many such commercially available viscous product cartridges 12. In addition, it may be necessary to rupture an internal seal (not shown) at the base of the nozzle that seals the dispensing orifice 18 and is often also included in such commercially available product cartridges 12. At the opposite end of the product cartridge 12 is a piston 20 that seals the end of the tube 12. The piston 20 operates as a movable wall that is capable of forcing product from the product enclosure 22 through the dispensing orifice 18 as the piston 20 moves toward the dispensing orifice 18.

As indicated above, the upper portion of the housing 14 operates as a product cartridge housing component 15. The product cartridge housing component 15 is adapted to cooperate with the viscous product cartridge 12 to form a gas enclosure 24 separated from the product enclosure 22 by the movable piston 20. In this embodiment, the product cartridge housing component 15 of the housing 14 is sealed to the cylindrical outer wall 16 of the product cartridge 12 using an O-ring 26 to form a gas enclosure 24 between the housing 14 and the product cartridge 12. The piston 20 or movable wall separates the gas enclosure 24 from the product enclosure 22 formed inside the product cartridge 12.

Although this embodiment has a relatively rigid cylindrical wall 16 and a movable piston 20, an alternative product cartridge (not shown) is made of flexible thin-film packaging material. The corresponding product cartridge housing component is modified to be sealed around the flexible side walls in this alternative embodiment providing a gas enclosure that surrounds the flexible side walls. Thus, the side walls can move toward each other under external pressure within the gas enclosure to force product through the dispensing orifice. Accordingly, the flexible thin-film side walls provide the movable walls in this alternative embodiment.

The upper portion of the housing 14 also includes a nozzle housing component 30 which is adapted to seal with a wall 28 of the product cartridge 12 that surrounds the dispensing orifice 18. As indicated above, this wall 28 can be provided by trimming the end of a nozzle from a standard caulk or adhesive product cartridge. A rubberized gasket (not shown) may be provided between the nozzle housing component 30 and the wall 28 of the product cartridge 12 to facilitate this seal. As another possible alternative, threads (not shown) may be provided to enable threaded engagement between the wall 28 of the product cartridge 12 and the nozzle housing component 30 to facilitate the seal therebetween.

The nozzle housing component 30 includes a dispensing passage 32 which is selectively opened and closed by a valve body 34. A spring 36 biases the valve body 34 downwardly into a closed position in which the dispensing passage 32 of the nozzle 30 is sealed as seen in FIG. 1. Actuation of a manually operated trigger 38 causes a cable 40 to counteract the biasing force of the spring 36 and push the valve body 34 upwardly into a dispensing or open position as see in FIG. 2. In this open position, product can be dispensed from the product cartridge 12 through the dispensing orifice 18 of the product cartridge 12 and through the dispensing passage 32 of the nozzle housing component 30.

In an alternative embodiment (not seen), the nozzle, including the valve body and dispensing passage, may be integrally provided as part of the product cartridge, rather than as part of the package housing. This configuration eliminates the need to seal the dispensing orifice of the product cartridge and the dispensing passage of the dispenser housing together. In contrast, the preferred embodiment described above enables re-use of the nozzle and valve assembly with multiple disposable product cartridges.

As indicated above, a lower portion 42 of the housing 14 of the dispensing device 10 operates as a handle for manually grasping the dispensing device 10. The manually actuated trigger 38 is associated with the handle 42. In addition, the lower portion of the housing 14 provides a gas cartridge housing component 42. A fluid passage 44 provides fluid communication between the gas enclosure 24 and a plurality of inlets 46, 48 located in the gas cartridge housing component 42 of the housing 14. The gas cartridge housing component 42 is adapted to retain a gas cartridge 50, 52 in sealed fluid communication with each of the inlets 46 and 48, respectively.

Specifically, each inlet 46, 48 of the passage 44 includes a resilient gasket seal member (not shown). Such gasket seal members are referenced as 153 with respect to the embodiment of FIG. 3. In addition, each inlet 46, 48 may include a piercing member (not shown) to pierce an opening in the gas cartridges 50, 52 upon sealing to the inlet 46 and 48, respectively. The gas cartridge housing component 42 includes a screw on cap 54 associated with each gas cartridge 50, 52. As the cap 54 is threaded onto the remainder of the gas cartridge housing component 42, the cap 54 pushes the gas cartridge 50, 52 into sealing engagement with the gasket seal member of a corresponding inlet 46, 48. In addition, screwing the cap 54 onto the remainder of the gas cartridge housing component 42 causes any piercing member to pierce the gas cartridge 50, 52. In any event, sealed fluid communication is provided between the interior of the gas cartridge 50, 52 and the fluid passage 44.

The overall fluid passage 44 includes an inlet passage 56, 58 associated with each inlet 46 and 48, respectively. The inlet passages 56, 58 join together to create a single outlet passage 60. A manifold 62 joins the plurality of inlet passages 56, 58 to the outlet passage 60 to form part of the overall fluid passage 44. A check valve 64 is located in an inlet passage 56 and associated with the inlet 46. The check valve 64 is biased to a closed position as seen in FIG. 1 by a spring 66. The check valve 64 is moved into an open position periodically by gas escaping from the pressurized $CO_2$ cartridge 50. Thus, when pressurized gas is not escaping from the $CO_2$ cartridge 50, the check valve is maintained in the closed position. In this closed position, gas is prevented from flowing through the check valve 64 and exiting the inlet passage 56 through the inlet 46. Consequently, when a pressurized $CO_2$ cartridge 50 is not located in sealed engagement with the inlet 46 associated with the check valve 64, pressurized gas coming from the other cartridge 52 attached to another inlet 48 will not escape through the empty inlet 46.

A pressure regulator 68 is located along the fluid passage 44, downstream of the inlet passages 46, 48. The pressure regulator 68 reduces the pressure of the pressurized gas flowing from the pressurized $CO_2$ gas cartridges 50, 52 to a lower level. This lower level of pressure is high enough to drive product from the product cartridge 12 at a desirable rate. Thus, the pressure regulator 68 receives gas from the fluid passage at a relatively high pressure at an inlet side facing toward the $CO_2$ cartridges 50, 52 and, after converting the gas to a reduced pressure, discharges the $CO_2$ gas from an outlet side of the pressure regulator into the fluid passage 44 toward the gas enclosure 24.

A gas flow control valve 70 is also located along the fluid passage 44. The gas flow control valve 70 is biased to a closed position by a spring 72. The gas flow control valve 70 is manually actuated by the trigger 38 which moves the valve 70 to an open position as seen in FIG. 2. In the open position, gas is permitted to travel along the passage 44 from the pressurized $CO_2$ cartridges 50, 52 to the gas enclosure 24. The resulting increase in gas within the gas enclosure 24 causes the pressure to increase until the piston 20 begins to move.

As indicated above, the trigger 38 is also connected to the nozzle valve body 34 to open the valve upon manual actuation. Thus, in this embodiment, the valve 34 of the dispensing passage 32 and the gas flow valve 70 are simultaneously opened. As the piston 20 begins to move, the volume of the gas enclosure 24 expands reducing the volume of the product enclosure 22 and dispensing product through the discharge orifice 18 and the dispensing passage 32. Upon release of the trigger 38, both the dispensing valve 34 and the gas flow control valve 70 move to their closed positions as seen in FIG. 1. Thus, the product within the product enclosure 22 is maintained under pressure due to the remaining gas pressure within the gas enclosure 24. Product does not continue to be dispensed, however, due to the valve 34 of the dispensing passage 32 being in a closed position.

Two additional valve mechanisms are located within the fluid passage 44 in this embodiment. One is a pressure release valve 74 that is additionally associated with the gas enclosure 24 and is biased to a closed position by a spring 76. The pressure release valve 74 may be manually moved to an open position to permit the release of gas pressure from the gas enclosure 24. This release of pressure can, for example, facilitate the replacement of the viscous product cartridge 12. A maximum pressure release valve 78 is also included in the fluid passage 44 that is designed to vent the $CO_2$ gas from the gas enclosure 24 should the pressure therein exceed a maximum pressure level.

Operation of the dispensing device of FIGS. 1 and 2 involves locating a product cartridge 12 in the product cartridge retaining housing component 15. As described above, this creates a gas enclosure 24 separated from a product enclosure 22 by a moveable wall 20. In addition, operation of the dispensing device 10 involves locating at least one $CO_2$ cartridge 52 inside the gas cartridge retaining housing component 42. The first $CO_2$ cartridge 52 is attached to the right inlet 48 (as seen in FIG. 1) by screwing cap 54 onto the housing 14. Gas from this cartridge 52 is prevented from exiting the passage 44 by the check valve 64, even though a second $CO_2$ cartridge 50 has not yet been sealed against the other inlet 46. In this way, the inlet valve 64 prevents gas from escaping through the other inlet 46 while a $CO_2$ cartridge is not attached thereto.

A second $CO_2$ cartridge 50 is then preferably located in sealed fluid communication with the left inlet 46 of the fluid passage 44 by screwing on the other cap 54 as described above. Each of the interiors of the $CO_2$ cartridges 50, 52 is located in sealed fluid communication with an inlet 46 and 48, respectively, of the passage 44 by screwing on the caps 54. Thus, the dispensing device 10 is capable of being driven by a plurality of $CO_2$ cartridges 50, 52.

Referring to FIG. 2, manually actuating the trigger 38 causes opening of both the nozzle valve 34 and the gas flow control valve 70. Pressurized gas from each of the $CO_2$ cartridges 50, 52 flows through the inlet passages 56, 58 and then flows together along the outlet passage 60. The pressurized $CO_2$ gas then passes through the pressure regulator 68 where the pressure of the gas is reduced to an operational pressure. A typical operational pressure is from about 20 to about 50 psi. This pressure is selected to affect a desirable dispensing rate of product without unnecessarily increasing the pressure. An adjustment mechanism (not shown) for the pressure regulator 68 may additionally be provided to enable a user to adjust the operating pressure for different products.

The pressurized gas flows past the open gas flow control valve 70 in the fluid passage 44 and into the gas enclosure 24. As the quantity of gas in the gas enclosure 24 increases, the gas begins to push against the piston 20. Since the nozzle valve 34 is open the piston 20 begins to move, thereby increasing the volume of the gas enclosure 24. Conversely, this movement of the piston 20 decreases the volume of the product enclosure 22. Thus, product is pushed from the product enclosure 22 through the dispensing orifice 18, and the open nozzle valve 34 in the dispensing passage 32. Upon release of the trigger 38, the gas flow control valve 70 closes to cause the flow of gas from the $CO_2$ cartridges 50, 52 to the gas enclosure 24 to cease. In addition, the nozzle valve 34 closes which causes the flow of product through the dispensing passage 32 to cease.

Figure 3:
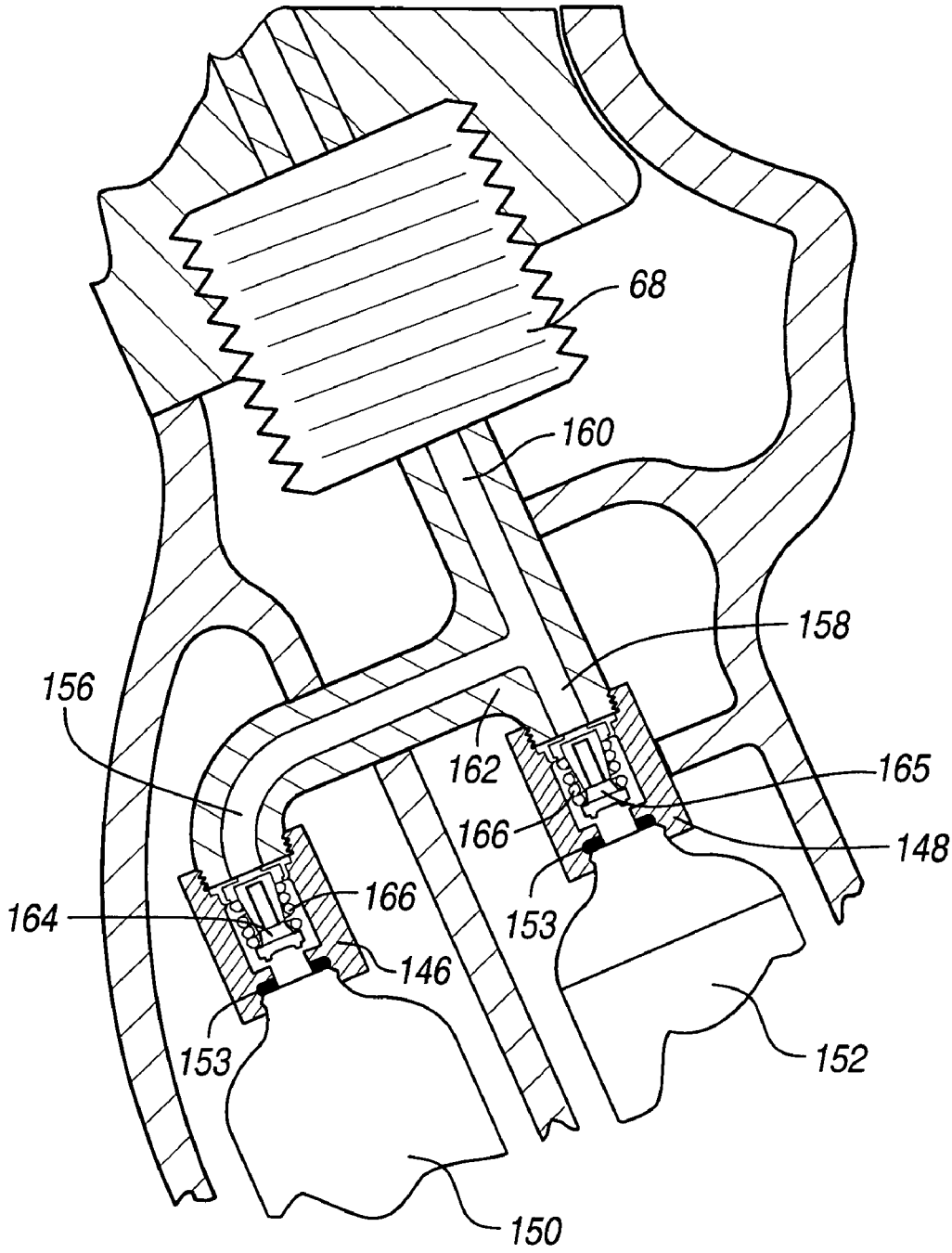
FIG. 3 is a fragmentary cross-sectional view of another preferred dispensing device of the present invention wherein a check valve is associated with each of the plurality of inlets.
Figure 4:
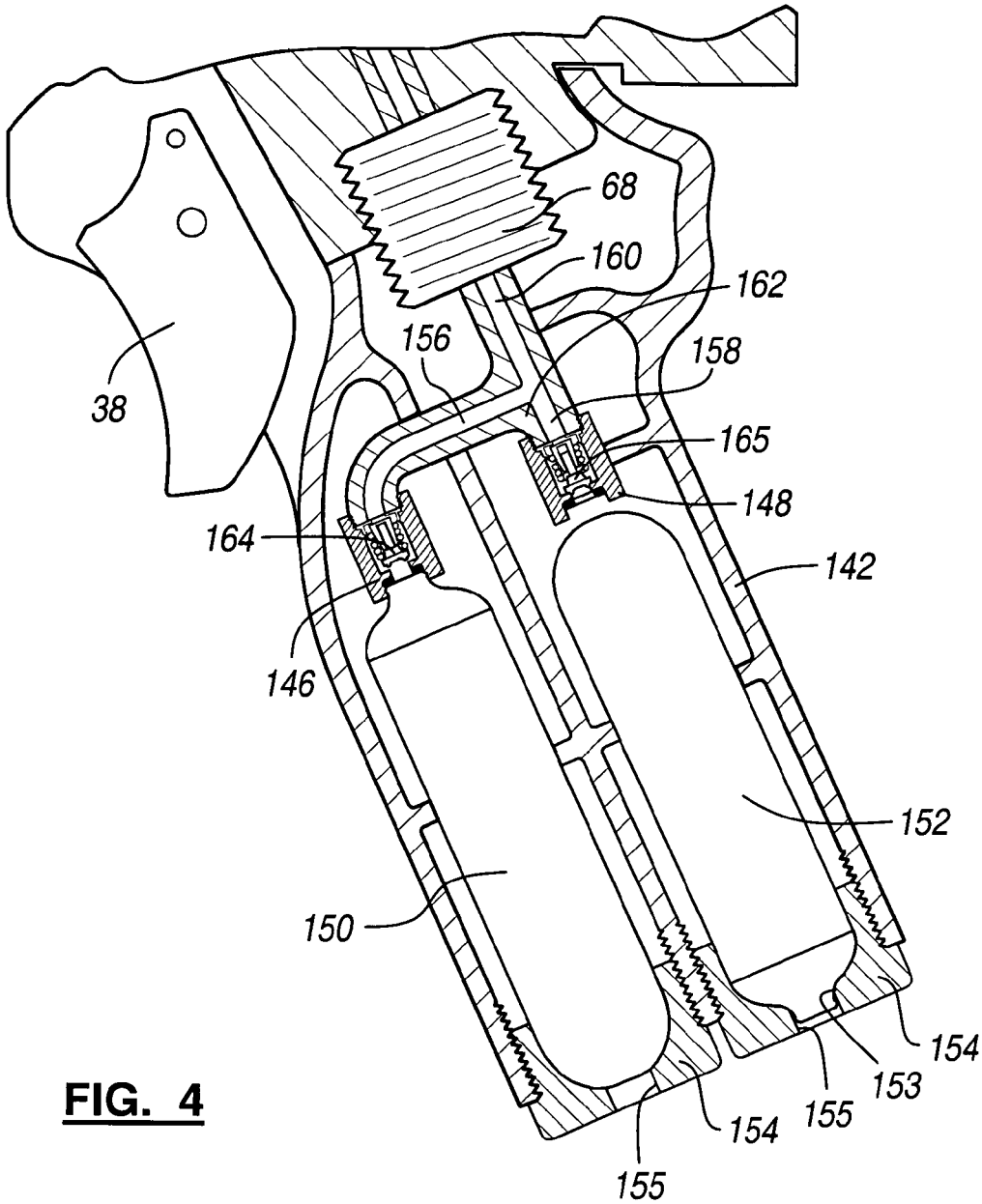
FIG. 4 is a fragmentary cross sectional view of the preferred embodiment of FIG. 3 illustrating one of the pressurized gas cartridges in a storage position.

Referring to FIGS. 3 and 4, an alternative embodiment is provided having a check valve 164, 165 associated with each inlet 146, 148 of the inlet passages 156, 158, respectively. The remainder of this embodiment beyond the fragmentary illustration of FIGS. 3 and 4 is essentially identical in form and function to the embodiment of FIGS. 1 and 2. Consequently, the remainder of this embodiment is not described again here. Although the check valves 164, 165 are not identical in construction to the check valve 64 of FIG. 1, they function identically.

Structurally, the check valves 164, 165 each have an inlet 146, 148 that is threaded onto the remainder of the manifold 162. A spring member 166 biases each valve body 164, 165 to a closed position where they seal against a valve seat. This closed position is illustrated in FIG. 4 with respect to the right valve 165. Thus, the check valves function identically to the check valve of the embodiment of FIGS. 1 and 2. Therefore, in this embodiment, a check valve 164, 165 is associated with each of the inlets 146 and 148, respectively. Accordingly, a fully pressurized $CO_2$ cartridge 150, 152 can be attached to either inlet 146, 148 in any order and without concern for whether a $CO_2$ cartridge 150 or 152 is sealed to the other inlet 146 or 148.

Referring to FIG. 4, one of the $CO_2$ cartridges 152 of the preferred embodiment of FIG. 3 is illustrated in a storage position. The valve 165 associated with the inlet 148 related to the $CO_2$ cartridge 152 in the storage position is illustrated in a closed position. The valve 164 associated with the other inlet 146 is illustrated in an open position. Because of the closed valve 165, pressurized gas from the fluid passage 160, 156, 158 cannot exit through the inlet 148 on the right.

Each of the caps 154 that is threaded onto the remainder of the gas cartridge housing component 142 includes an opening 155 therethrough. This opening 155 is adapted to accommodate the neck portion 153 of the gas cartridge 152 when the gas cartridge 152 is inserted in the housing component 142 in a storage orientation. The storage orientation of this embodiment is an orientation that is 180 degrees from the sealed, operational orientation. Thus, the $CO_2$ cartridge 152 is held in the storage orientation within the cartridge housing component 142 without sealing the $CO_2$ cartridge 152 to the inlet 148. When it is desired to use the stored $CO_2$ cartridge 152, it is removed from the housing component 142, rotated 180 degrees and reinserted into the product cartridge housing component 142 and sealed to the inlet 148 upon attachment of the cap 154 as previously described.

The opening 155 through the cap 154 of this embodiment also enables a user to look into the $CO_2$ cartridge housing component 142. Thus, it is possible to verify whether a $CO_2$ cartridge 150, 152 is located within the $CO_2$ cartridge housing component 142 adjacent the cap 154. Similarly, it is possible to verify the orientation of any $CO_2$ cartridge 150, 152 that is located within the $CO_2$ cartridge housing component 142 adjacent the cap 154. Thus, the opening 155 provides a window through which the status of any $CO_2$ cartridge 150, 152 within the $CO_2$ cartridge housing component 142 can be visually determined.

Only a small number of the many possible alternatives are described above. Many additional modifications and alternatives beyond those described above, may be envisioned by those skilled in the art. For example, the nozzle valve or gas flow control valve may operate independently rather than being both associated with a single trigger. Further, the nozzle valve and/or the gas flow valve may be eliminated completely. As another potential modification, the storage location may be provided in a location that is not associated with the inlet and/or the interior of the $CO_2$ cartridge housing component. Thus, one or more $CO_2$ cartridges may be stored on the dispensing device in addition to the number of inlets.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A dispensing device for dispensing a viscous product that is adapted to be driven by a plurality of pressurized gas cartridges, the dispensing device comprising:

a manifold having a plurality of inlet passages, each of the plurality of inlet passages providing fluid communication between an inlet and an outlet passage;

a housing adapted to retain a pressurized gas cartridge in sealed fluid communication with each of the plurality of inlet passages; and a check valve in at least one of the plurality of inlet passages, the check valve being biased to a closed position that prevents gas from flowing through the check valve to the inlet of the at least one of the plurality of inlet passages;

wherein the dispensing device is adapted to use gas delivered through the outlet passage from the plurality of pressurized gas cartridges to dispense the viscous product from the dispensing device; and wherein the housing is further adapted to retain a reserve gas cartridge in a non-use position, the non-use position being a position in which the gas cartridge is not sealingly engaged with any one of the inlets.

2. A dispensing device for dispensing a viscous product according to claim 1, wherein a check valve is located in each of the plurality of inlet passages, each check valve being biased to a closed position that prevents gas from flowing through the check valve to the inlet of the inlet passage in which the check valve is located.

3. A dispensing device for dispensing a viscous product according to claim 2, wherein the non-use position is located within an interior of the housing, and further comprising a viewing opening into the interior of the housing adapted to enable a visual determination of whether a reserve gas cartridge is located in the non-use position.

4. A dispensing device for dispensing a viscous product according to claim 1, further comprising a viewing opening into an interior of the housing adapted to enable visual access to any pressurized gas cartridge located within the interior of the housing.

5. A dispensing device for dispensing a viscous product according to claim 1, wherein the housing includes a cap that is adapted to accommodate a neck of a pressurized gas cartridge when a pressurized gas cartridge is in a non-use position.

6. A dispensing device adapted to dispense a viscous product from a viscous product cartridge, the dispensing device also being adapted to be driven by a plurality of pressurized gas cartridges, the dispensing device comprising;

a product cartridge housing component adapted to retain the viscous product cartridge and to cooperate with the viscous product cartridge to form a gas enclosure separated from a product enclosure by a movable wall;

a fluid passage having a plurality of inlets, the fluid passage providing fluid communication between the plurality of inlets and the gas enclosure;

a gas cartridge housing component adapted to retain each of the plurality of pressurized gas cartridges in sealed fluid communication with one of the plurality of inlets; and a check valve in the passage associated with each of the plurality of inlets, each check valve being biased to a closed position that prevents gas from flowing through the check valve to the inlet with which the check valve is associated.

7. A dispensing device for dispensing a viscous product according to claim 6, further comprising a housing including the product cartridge housing component and the gas cartridge housing component and wherein the housing is further adapted to retain a reserve gas cartridge in a non-use position, the non-use position being a position in which the gas cartridge is not sealingly engaged with any one of the inlets.

8. A dispensing device for dispensing a viscous product according to claim 6, further comprising a viewing opening into an interior of the gas cartridge housing component to enable visual access to any pressurized gas cartridge located within the interior of the housing.

9. A dispensing device for dispensing a viscous product according to claim 6, further comprising a pressure regulator located along the passage and adapted to reduce a pressure level of gas exiting the pressure regulator and flowing toward the gas enclosure from that of a pressure level of gas entering the pressure regulator from the plurality of pressurized gas cartridges.

10. A dispensing device for dispensing a viscous product according to claim 9, further comprising a product dispensing valve associated with a dispensing orifice of the viscous product cartridge and a manually operated trigger adapted to move the product dispensing valve between an open position and a closed position.

11. A dispensing device for dispensing a viscous product according to claim 10, further comprising a gas flow control valve associated with the fluid passage, wherein the manually operated trigger is further adapted to move the gas flow control valve between an open position and a closed position.

12. A dispensing device for dispensing a viscous product, the dispensing device being adapted to be driven by a plurality of pressurized gas cartridges, comprising;

a movable wall separating a product enclosure from a gas enclosure, the product enclosure having a dispensing orifice;

a fluid passage having a plurality of inlets, the fluid passage providing fluid communication between the plurality of inlets and the gas enclosure, each of the plurality of inlets being adapted to seal to one of the plurality of pressurized gas cartridges;

a check valve in the fluid passage associated with each of the plurality of inlets and having an open position that permits gas to flow from the inlet with which the check value is associated through the check valves, and each check valve being biased to a closed position that prevents gas from flowing through the check valve and exiting the passage through the inlet with which the check value is associated;

wherein the dispensing device is adapted to cause gas from the gas cartridges to flow through the fluid passage into the gas enclosure and to cause the movable wall to move so that the gas enclosure expands and the product enclosure contracts, to thereby cause viscous product to be dispensed through the dispensing orifice of the product enclosure.

13. A dispensing device for dispensing a viscous product according to claim 12, further comprising a housing adapted to retain a reserve gas cartridge in a non-use position, the non-use position being a position in which the reserve pressurized gas cartridge is not sealingly engaged with any one of the inlets.

14. A dispensing device for dispensing a viscous product according to claim 12, further comprising a housing having a viewing opening into an interior of the housing to enable visual access to any pressurized gas cartridge located within the interior of the housing.

15. A dispensing device for dispensing a viscous product according to claim 12, further comprising a pressure regulator located along the passage adapted to reduce a pressure level of gas exiting the pressure regulator and flowing toward the gas enclosure from that of a pressure level of gas entering the pressure regulator from the plurality of gas cartridges.

16. A dispensing device for dispensing a viscous product according to claim 15, further comprising a product dispensing valve associated with a dispensing orifice of the viscous product cartridge and a manually operated trigger associated with the housing and adapted to move the product dispensing valve between an open position and a closed position.

17. A dispensing device for dispensing a viscous product according to claim 16, further comprising a gas flow control valve associated with the fluid passage, wherein the manually operated trigger is further adapted to move the gas flow control valve between an open position and a closed position.

* * * * *